US010518183B2

(12) United States Patent
Evazians

(10) Patent No.: US 10,518,183 B2
(45) Date of Patent: Dec. 31, 2019

(54) LIGHT-UP TOY WITH MOTION SENSING CAPABILITIES

(71) Applicant: Ramseen E. Evazians, Cresskill, NJ (US)

(72) Inventor: Ramseen E. Evazians, Cresskill, NJ (US)

( * ) Notice: Subject to any disclaimer, the term of this patent is extended or adjusted under 35 U.S.C. 154(b) by 0 days.

(21) Appl. No.: 16/153,743

(22) Filed: Oct. 6, 2018

(65) Prior Publication Data

US 2019/0126155 A1 May 2, 2019

Related U.S. Application Data

(60) Provisional application No. 62/578,382, filed on Oct. 27, 2017.

(51) Int. Cl.

| | |
|---|---|
| ***A63H 33/22*** | (2006.01) |
| ***A63H 3/00*** | (2006.01) |
| ***A63H 3/28*** | (2006.01) |
| ***A63H 33/26*** | (2006.01) |

(52) U.S. Cl.

CPC ..... *A63H 3/006* (2013.01); *A63H 3/003* (2013.01); *A63H 3/28* (2013.01); *A63H 33/26* (2013.01); *A63H 2200/00* (2013.01)

(58) Field of Classification Search

CPC ..... A63H 3/006; A63H 3/003; A63H 33/26; A63H 3/28; A63H 2200/00

USPC ... 446/72, 81, 175, 219, 297, 330, 369, 385, 446/394, 485, 486

See application file for complete search history.

(56) References Cited

U.S. PATENT DOCUMENTS

| | | | |
|---|---|---|---|
| 4,479,329 | A | 10/1984 | Fraden |
| 5,052,969 | A | 10/1991 | Smith |
| 5,211,282 | A | 5/1993 | Ting |
| 5,267,886 | A | 12/1993 | Wood |
| 5,439,407 | A | 8/1995 | Friedel |
| 5,501,627 | A | 3/1996 | Ekstein |
| 5,672,090 | A | 9/1997 | Liu |

(Continued)

OTHER PUBLICATIONS

Uncle Milton Industries. Moon in My Room with Light-up Lunar Phases. Instruction, 2011. [retrieved Oct. 12, 2018]. Retrieved from the Internet. [URL: http://unclemilton.com/manuals/moon_in_my_room_manual_1.pdf].*

(Continued)

*Primary Examiner* — Nini F Legesse
(74) *Attorney, Agent, or Firm* — Quickpatents, LLC; Kevin Prince

(57) ABSTRACT

A toy for use in an environment, such as a bedroom of a child that has a horizontal floor or shelf, includes an enclosure, such as a plush toy, that has an outside surface defining an interior volume. An internal circuit is electrically connected to a battery, a timer function, a transducer such as an LED, a user input switch, and at least one environmental sensor such as a motion sensor. The circuit includes an off mode, a guard mode wherein the circuit actuates the at least one transducer for a first active time interval upon detection of an environmental change, and optionally a companion mode wherein the circuit activates the at least one transducer for a second active time interval upon detection of an environmental change by the at least one environmental sensor. Thereafter the circuit deactivates the at least one transducer after a second all-quite time interval.

20 Claims, 2 Drawing Sheets

(56) References Cited

U.S. PATENT DOCUMENTS

| | | | | |
|---|---|---|---|---|
| 5,791,965 | A * | 8/1998 | Kim | A63H 3/006 446/219 |
| 6,089,943 | A | 7/2000 | Lo | |
| 6,139,394 | A * | 10/2000 | Maxim | A63H 3/006 446/219 |
| 6,142,846 | A | 11/2000 | Ojakaar | |
| 6,165,037 | A * | 12/2000 | Van Zant | A63H 3/006 446/219 |
| 6,253,058 | B1 | 6/2001 | Murasaki | |
| 6,275,163 | B1 | 8/2001 | Bogorad et al. | |
| 6,431,937 | B1 | 8/2002 | Lau | |
| 6,695,672 | B1 | 2/2004 | Rehkemper | |
| 7,491,111 | B2 | 2/2009 | Ghaly | |
| 8,210,896 | B2 | 7/2012 | Wittenberg | |
| 8,568,189 | B2 | 10/2013 | Garbos | |
| 8,801,490 | B2 | 8/2014 | Achan | |
| 9,474,981 | B1 | 10/2016 | Forti | |
| 9,573,069 | B2 | 2/2017 | Cannon | |
| 2001/0031602 | A1 | 10/2001 | Sagi-Dolev | |
| 2006/0278816 | A1 | 12/2006 | Booty | |
| 2008/0026672 | A1 | 1/2008 | Hardin | |
| 2008/0176481 | A1 | 7/2008 | Zebersky | |
| 2009/0030808 | A1 | 1/2009 | Park | |
| 2009/0305600 | A1 | 12/2009 | Roesch | |
| 2013/0090036 | A1 | 4/2013 | Bell | |
| 2014/0038489 | A1 | 2/2014 | Sharma | |
| 2014/0183326 | A1 | 7/2014 | Ples | |
| 2014/0357150 | A1 | 12/2014 | Achan | |
| 2015/0017873 | A1 | 1/2015 | Breckman | |
| 2015/0290548 | A1 | 10/2015 | Meyers | |
| 2016/0174901 | A1 | 6/2016 | Majic | |
| 2017/0113151 | A1 | 4/2017 | Smith | |
| 2017/0120155 | A1 | 5/2017 | Nicholls | |

OTHER PUBLICATIONS

Kids' Toy Talk. FurReal Friends StarLily Unicorn Review, 2016. [retrieved on Oct. 12, 2018]. Retrieved from the Internet. [URL: https://kidstoystalk.com/furreal-friends-starlily-unicordn-review].

* cited by examiner

LIGHT-UP TOY WITH MOTION SENSING CAPABILITIES

CROSS-REFERENCE TO RELATED APPLICATIONS

This application claims the benefit of U.S. Provisional Patent Application 62/578,382, filed on Oct. 27, 2017, and incorporated herein by reference.

STATEMENT REGARDING FEDERALLY SPONSORED RESEARCH AND DEVELOPMENT

Not Applicable.

FIELD OF THE INVENTION

This invention relates to toys, and more particularly to a plush toy with motion sensing capabilities.

DISCUSSION OF RELATED ART

Children often have trouble going to sleep at night because of fear of the dark, monsters, and other nuisances. Many children prefer to have a light kept on in their bedroom, but unless the light is on a timer, parents run the risk of the child waking at some point during the night because of the brightness of the light. Further, prolonged sleeping in a lit environment has been shown to be detrimental to eyesight and cause other health problems. Keeping a light on during sleeping hours also wastes electricity.

Therefore, there is a need for a device that will illuminate the bedroom if there is a disturbance in the room, such as a person or pet walking into the room. As such, the child will understand that the room will light-up if any disagreeable creatures enter the room. Further, such a needed device would provide companionship by illuminating if moved or touched while being held by the child, providing reassurance to the child that he can illuminate the room at any time he wants by moving or nudging the device. Such a needed invention would further preserve battery power by only working in any particular mode for only a preset period of time. The present invention accomplishes these objectives.

SUMMARY OF THE INVENTION

The present device is a toy for use in an environment that includes a horizontal surface, such as a bedroom of a child that has a floor or shelf. Typically the toy is used at bedtime when the child may be comforted by an interactive companion toy that can illuminate the bedroom, make comforting sounds, and yet not wake the child after the child has fallen asleep. Clearly, however, the toy could be used in any other environment at the user's discretion.

The toy includes an enclosure that has an outside surface defining an interior volume therein. A sensor portion of the enclosure is configured for facing a first direction when the enclosure is rested on the horizontal surface. A circuit is disposed at least partially in the interior volume of the enclosure. The circuit is electrically connected with at least one battery, a timer function, at least one transducer, at least one user input switch accessible at the outside surface of the enclosure, and at least one environmental sensor.

Such a transducer is preferably one or more LED lamps, but can also include a speaker, a vibration producing mechanism such as a small motor with an offset weight, or the like.

Such an environmental sensor is preferably a motion sensor, or a light sensor, or both, disposed in the sensor portion of the enclosure and configured to detect motion and light in generally the first direction of the environment.

The circuit is configured to include an off mode where the toy is deactivated, and a guard mode wherein the circuit actuates the at least one transducer for a first active time interval upon detection of an environmental change, such as by a person or pet coming into the environment. Thereafter the circuit deactivates the at least one transducer after a first all-quiet time interval, during which no change is detected in the environment by the at least one environmental sensor. Preferably the guard mode is active only for a preset first enabled time interval, such as eight hours, during sleeping hours, after which the circuit enters the off mode.

Preferably the circuit is further configured to include a companion mode wherein the circuit activates the at least one transducer for a second active time interval upon detection of an environmental change by the at least one environmental sensor. Thereafter the circuit deactivates the at least one transducer after a second all-quite time interval, during which no change is detected in the environment by the at least one environmental sensor. In such an embodiment, the companion mode is active only for a preset second enabled time interval, such as an hour (long enough for the child to go to sleep), after which the circuit enters either the off mode or the guard mode.

Preferably the enclosure takes the form of a plush animal wherein the at least one environmental sensor is disposed proximate a face or chest of the animal. Such an enclosure may take the form as a unicorn, for example, wherein the at least one environmental sensor is disposed facing forward, proximate a tip of the horn of the unicorn. In such an embodiment the horn of the unicorn is at least partially non-opaque and at least one of the transducers is one or more of the LEDs disposed within the horn to provide illumination of the surroundings proximate the unicorn.

Further, the at least one user input switch is preferably disposed at the foot of the animal. Other of the at least one user input switches may be utilized to change the timing intervals, or the color or color pattern of the at least one LED lamp, the sensitivity of any of the environmental sensors, or the like.

The present invention is a device that illuminates the environment if there is a disturbance, such as a person or pet walking into the room. Further, the present device provides companionship by illuminating and, optionally, making soothing sounds if moved or touched while being held by the child as the child falls asleep, providing reassurance to the child that he can illuminate the room at any time he wants by moving or nudging the device. Such a needed invention preserves battery power by only working in any particular mode, guard mode or companion mode, for only a preset period of time. Other features and advantages of the present invention will become apparent from the following more detailed description, taken in conjunction with the accompanying drawings, which illustrate, by way of example, the principles of the invention.

DETAILED DESCRIPTION OF THE PREFERRED EMBODIMENT

Illustrative embodiments of the invention are described below. The following explanation provides specific details for a thorough understanding of and enabling description for these embodiments. One skilled in the art will understand that the invention may be practiced without such details. In other instances, well-known structures and functions have not been shown or described in detail to avoid unnecessarily obscuring the description of the embodiments.

Unless the context clearly requires otherwise, throughout the description and the claims, the words "comprise," "comprising," and the like are to be construed in an inclusive sense as opposed to an exclusive or exhaustive sense; that is to say, in the sense of "including, but not limited to." Words using the singular or plural number also include the plural or singular number respectively. Additionally, the words "herein," "above," "below" and words of similar import, when used in this application, shall refer to this application as a whole and not to any particular portions of this application. When the claims use the word "or" in reference to a list of two or more items, that word covers all of the following interpretations of the word: any of the items in the list, all of the items in the list and any combination of the items in the list. When the word "each" is used to refer to an element that was previously introduced as being at least one in number, the word "each" does not necessarily imply a plurality of the elements, but can also mean a singular element.

Figure 1:
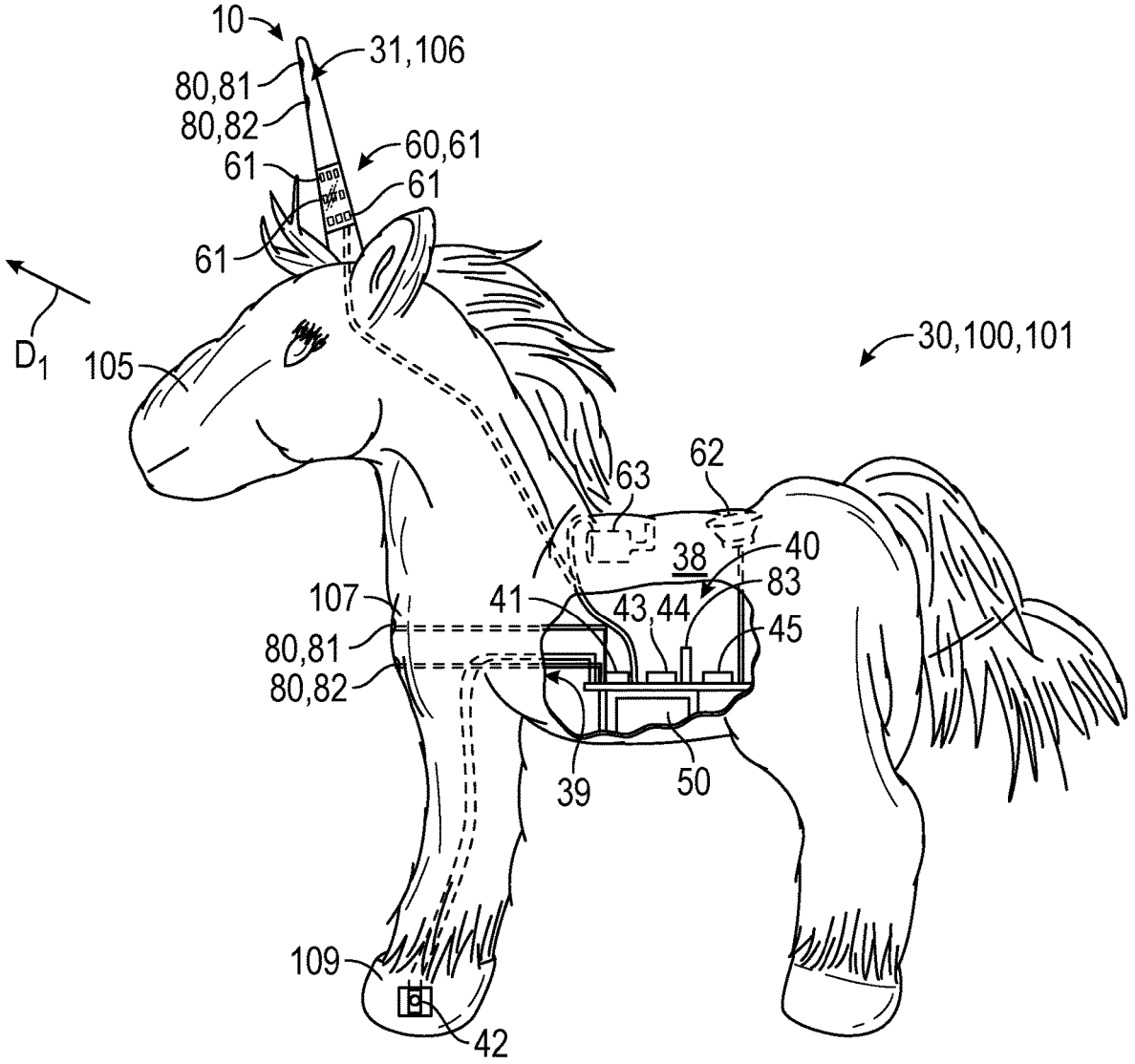
FIG. 1 is a side elevational view of the invention, partially broken-away to reveal components of an internal circuit thereof.
Figure 2:
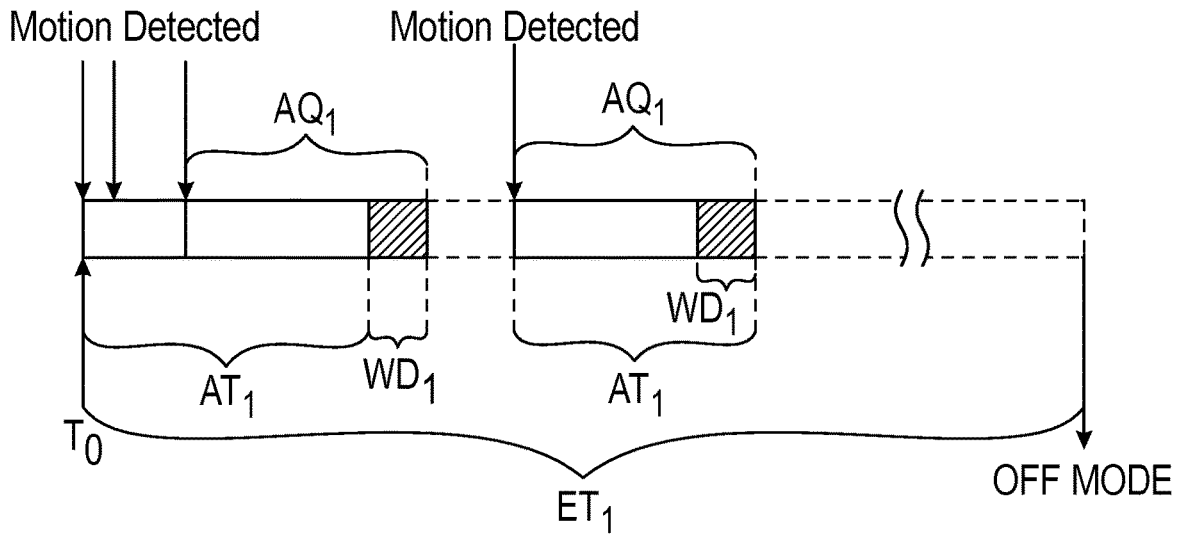
FIG. 2 is a timing diagram of a guard mode of the invention.
Figure 3:
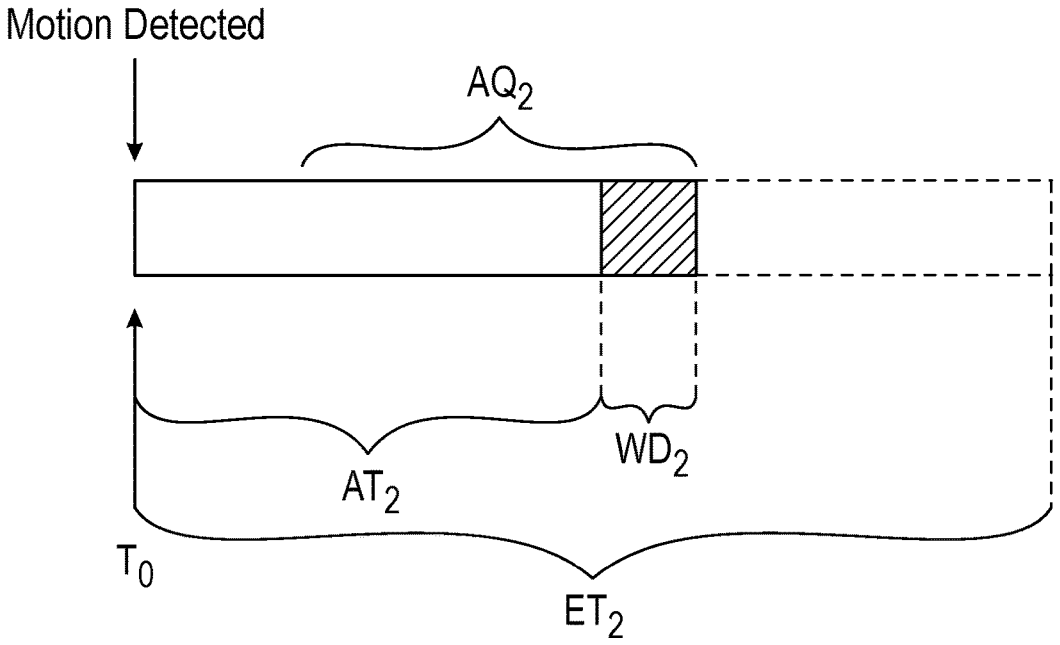
FIG. 3 is a timing diagram of a companion mode of the invention.

FIGS. 1-3 illustrate a toy 10 for use in an environment 15 that includes a horizontal surface 18, such as a bedroom of a child 20 that has a floor 15 or shelf 15. Typically the toy 10 is used at bedtime when the child 20 may be comforted by an interactive companion toy 10 that can illuminate the bedroom, make comforting sounds, and yet not wake the child 20 after the child 20 has fallen asleep.

The toy 10 includes an enclosure 30 that has an outside surface 38 defining an interior volume 39 therein. A sensor portion 31 of the enclosure 30 is configured for facing a first direction $D_1$ when the enclosure 30 is rested on the horizontal surface 18. A circuit 40 is disposed at least partially in the interior volume 39 of the enclosure 30. The circuit 40 is electrically connected with a power source 50, such as at least one battery 50, a timer function 41, at least one transducer 60, at least one user input switch 42 accessible at the outside surface 38 of the enclosure 30, and at least one environmental sensor 80.

Such a transducer 60 is preferably one or more LED lamps 61, but can also include a speaker 62, a vibration producing mechanism 63 such as a small motor with an offset weight, or the like. In the embodiment having the speaker 62, the circuit 40 may further include playback sounds 44 stored in a memory 43 as well as optionally an amplifier 45 (FIG. 1). The toy 10 may include some or all of these transducers 60 in any combination, such that when active the toy 10 illuminates, makes a purring sound (for example), and wiggles periodically through vibration. Alternately, the toy 10 may just include LEDs 61 for example, that are lit statically or alternate through a preset color pattern.

Such an environmental sensor 80 is preferably a motion sensor 81, or a light sensor 82, disposed in the sensor portion 31 of the enclosure 30 and configured to detect motion in generally the first direction of the environment 15. The at least one environmental sensor 80 may further include an ultrasonic detector (not shown), a microphone (not shown) or the like for detecting human or pet activity through echo location, sound, change in lighting characteristics, change in infrared profile of the environment 15, or the like.

The circuit 40 is configured to include an off mode 70 wherein power is disconnected form the at least one transducer 60 and the at least one environmental sensor 80, such as by actuating the at least one user input switch 42, or actuating the at least one user input switch 42 for a preset period of time.

The circuit 40 is further configured to include a guard mode 71 wherein the circuit 40 actuates the at least one transducer 60 for a first active time interval $AT_1$ upon detection of an environmental change, such as by a person or pet coming into the environment 15, by the at least one environmental sensor 80 (FIG. 2). Thereafter the circuit 40 deactivates the at least one transducer 80 after a first all-quiet time interval $AQ_1$, during which no change is detected in the environment by the at least one environmental sensor 80. That is, after activation and after the expiration of the first active time interval $AT_1$, the circuit 40 may deactivate the at least one transducer 80 once the environment 15 has been quiet, or has not had any detected movement, for the first all-quiet time interval $AQ_1$.

Preferably the guard mode 71 is active only for a preset first enabled time interval $ET_1$, such as eight hours, ie., during sleeping hours, after which the circuit 40 enters the off mode 70. This reduces drain of the battery 50 if the toy 10 is activated after the child 20 has awoken. Alternately, the guard mode 71 is active only while daylight is not detected by the light sensor 82. Further, preferably the circuit 40, when deactivating the at least one transducer 60, gradually lowers the at least one transducer 60 from full power to off over a first wind-down time interval $WD_1$. For example, in embodiments having the one or more LED lamps 61, the LED lamps 61 may dim until extinguished over the wind-down time interval $WD_1$. Alternately, in embodiments having a speaker 82 or other transducers 80, the volume of playback sounds 44 may be reduced until inaudible.

Preferably the circuit 40 is further configured to include a companion mode 72 wherein the circuit 40 activates the at least one transducer 60 for a second active time interval $AT_2$ (FIG. 3) upon detection of an environmental change by the at least one environmental sensor 80. Thereafter the circuit 40 deactivates the at least one transducer 60 after a second all-quite time interval $AQ_2$, during which no change is detected in the environment by the at least one environmental sensor 80.

In such an embodiment, the companion mode 72 is active only for a preset second enabled time interval $ET_2$, such as an hour, after which the circuit 40 enters either the off mode 70 or the guard mode 71.

In one embodiment, one of the environmental sensors 80 may include an orientation sensor 83, wherein the toy 10 only enters the guard mode 71 after having been in the companion mode 72 if the orientation sensor 83 detects that the toy 10 has been placed on the horizontal surface 18, and if not, instead enters the off mode 70. Further, when in the companion mode 72, and when deactivating the at least one transducer 60, the circuit 40 gradually lowers the at least one transducer 60 from full power to off over a second wind-down time interval $WD_2$.

Preferably the enclosure 30 takes the form of a plush animal 100 wherein the at least one environmental sensor 80 is disposed proximate a face 105 or chest 107 of the animal 100. Such an enclosure may take the form as a unicorn 101, for example, wherein the at least one environmental sensor 80 is disposed facing forward, proximate a tip of the horn 106 of the unicorn 101. In such an embodiment the horn 106 of the unicorn 101 is at least partially non-opaque and at least one of the transducers 60 is one or more of the LEDs 61 disposed within the horn 106 to provide illumination of the surroundings proximate the unicorn 101. Preferably the horn 106 and the unicorn 101 are made from a soft or resilient material.

Further, the at least one user input switch 42 is preferably disposed at the foot 109 of the animal 100. Other of the at least one user input switches 42 may be utilized to change the timing intervals $AT_1$, $AT_2$, $AQ_1$, $AQ_2$, $ET_1$, $ET_2$, $WD_1$, $WD_2$, or the color or color pattern of the at least one LED lamp 61, the sensitivity of any of the environmental sensors 80, or the like. Preferably the guard mode 71 is activated by actuating the at least one user input switch 42 once. In embodiments of the toy 10 having the companion mode 72, the guard mode 71 is activated by actuating the at least one user input switch once, and the companion mode 72 is activated by actuating the at least one user input switch twice. In such an embodiment the off mode 70 is activated by actuating the at least one user input switch three times, or for perhaps a long period of time such as longer than two seconds, or the like.

While a particular form of the invention has been illustrated and described, it will be apparent that various modifications can be made without departing from the spirit and scope of the invention. For example, the enclosure 30 may take any suitable form, including animals 100 other than unicorns 101, or other shapes altogether. Accordingly, it is not intended that the invention be limited, except as by the appended claims.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless the above Detailed Description section explicitly defines such terms. Accordingly, the actual scope of the invention encompasses not only the disclosed embodiments, but also all equivalent ways of practicing or implementing the invention.

The above detailed description of the embodiments of the invention is not intended to be exhaustive or to limit the invention to the precise form disclosed above or to the particular field of usage mentioned in this disclosure. While specific embodiments of, and examples for, the invention are described above for illustrative purposes, various equivalent modifications are possible within the scope of the invention, as those skilled in the relevant art will recognize. Also, the teachings of the invention provided herein can be applied to other systems, not necessarily the system described above. The elements and acts of the various embodiments described above can be combined to provide further embodiments.

All of the above patents and applications and other references, including any that may be listed in accompanying filing papers, are incorporated herein by reference. Aspects of the invention can be modified, if necessary, to employ the systems, functions, and concepts of the various references described above to provide yet further embodiments of the invention.

Changes can be made to the invention in light of the above "Detailed Description." While the above description details certain embodiments of the invention and describes the best mode contemplated, no matter how detailed the above appears in text, the invention can be practiced in many ways. Therefore, implementation details may vary considerably while still being encompassed by the invention disclosed herein. As noted above, particular terminology used when describing certain features or aspects of the invention should not be taken to imply that the terminology is being redefined herein to be restricted to any specific characteristics, features, or aspects of the invention with which that terminology is associated.

While certain aspects of the invention are presented below in certain claim forms, the inventor contemplates the various aspects of the invention in any number of claim forms. Accordingly, the inventor reserves the right to add additional claims after filing the application to pursue such additional claim forms for other aspects of the invention.

What is claimed is:

1. A toy for use with a child in a sleeping environment that includes a horizontal surface, comprising:

an enclosure having an outside surface defining an interior volume therein, a sensor portion of the enclosure configured for facing a first direction when the enclosure is rested on the horizontal surface;

a circuit disposed at least partially in the interior volume of the enclosure, the circuit electrically connected with a power source, a timer function, at least one transducer, at least one user input switch accessible at the outside surface of the enclosure, and at least one environmental sensor disposed in the sensor portion of the enclosure and configured to detect motion in the first direction of the environment;

the circuit configured to include:

an off mode wherein power is disconnected from the at least one transducer and the at least one environmental sensor;

a guard mode wherein the circuit actuates the at least one transducer for a first active time interval upon detection of an environmental change by the at least one environmental sensor, thereafter the circuit deactivates the at least one transducer after a first all-quiet time interval during which no change is detected in the environment by the at least one environmental sensor;

the mode selected by successive actuations of the at least one user input switch, wherein at least one of the first active time interval and the first all-quiet time interval are user adjustable.

2. The toy of claim 1 wherein the at least one environmental sensor includes a motion sensor.

3. The toy of claim 1 wherein the at least one environmental sensor includes a light sensor.

4. The toy of claim 1 wherein the guard mode is active only for a preset first enabled time interval, after which the circuit enters the off mode.

5. The toy of claim 1 wherein the circuit when deactivating the at least one transducer gradually lowers the at least one transducer from full power to off over a first wind-down time interval.

6. The toy of claim 1 wherein the circuit is further configured to include:

a companion mode wherein the circuit activates the at least one transducer for a second active time interval upon detection of an environmental change by the at least one environmental sensor, thereafter the circuit deactivates the at least one transducer after a second all-quiet time interval during which no change is detected in the environment by the at least one environmental sensor.

7. The toy of claim 6 wherein the companion mode is active only for a preset second enabled time interval, after which the circuit enters the off mode.

8. The toy of claim 6 wherein the companion mode is active only for a preset second enabled time interval, after which the circuit enters the guard mode.

9. The toy of claim 6 wherein the at least one environmental sensor includes an orientation sensor, and wherein the companion mode is active only for a preset second enabled time interval, after which if the orientation sensor detects that the toy has been placed on the horizontal surface the circuit enters the guard mode, otherwise the circuit enters the off mode.

10. The toy of claim 6 wherein the circuit when deactivating the at least one transducer gradually lowers the at least one transducer from full power to off over a second dimming time interval.

11. The toy of claim 6 wherein the guard mode is activated by actuating the at least one user input switch once, and the companion mode is activated by actuating the at least one user input switch twice, and the off mode is activated by actuating the at least one user input switch three times.

12. The toy of claim 6 wherein the guard mode is activated by actuating the at least one user input switch once, and the companion mode is activated by actuating the at least one user input switch at least twice, and the off mode is activated by actuating the at least one user input switch for longer than two seconds.

13. The toy of claim 1 wherein the enclosure takes the form of a plush animal, and the at least one environmental sensor is disposed proximate the face or chest of the animal.

14. The toy of claim 13 wherein the at least one user input switch is disposed at a foot of the animal.

15. The toy of claim 1 wherein the enclosure takes the shape of a unicorn, and the at least one environmental sensor is disposed facing forward, proximate a tip of a horn or the chest of the unicorn.

16. The toy of claim 15 wherein the horn of the unicorn is at least partially non-opaque and wherein the at least one transducer includes an LED lamp disposed within the horn to illuminate the surroundings around the unicorn.

17. The toy of claim 1 wherein the guard mode is activated by actuating the at least one user input switch once.

18. The toy of claim 1 wherein the at least one transducer includes an LED Lamp.

19. The toy of claim 1 wherein the at least one transducer includes a speaker and the circuit further includes playback sounds in a memory of the circuit and an amplifier circuit.

20. The toy of claim 1 wherein the at least one transducer includes a vibration producing mechanism.

* * * * *